US011779972B2

(12) United States Patent
Yang et al.

(10) Patent No.: US 11,779,972 B2
(45) Date of Patent: Oct. 10, 2023

(54) METHOD FOR PIERCING TITANIUM ALLOY SOLID BILLET

(71) Applicant: Northwestern Polytechnical University, Xi'an (CN)

(72) Inventors: Yanhui Yang, Xi'an (CN); Dong Liu, Xi'an (CN); Jianguo Wang, Xi'an (CN)

(73) Assignee: NORTHWESTERN POLYTECHNICAL UNIVERSITY, Xi'an (CN)

( * ) Notice: Subject to any disclaimer, the term of this patent is extended or adjusted under 35 U.S.C. 154(b) by 2 days.

(21) Appl. No.: 17/483,925

(22) Filed: Sep. 24, 2021

(65) Prior Publication Data

US 2022/0008975 A1 Jan. 13, 2022

Related U.S. Application Data

(63) Continuation-in-part of application No. 16/822,057, filed on Mar. 18, 2020, now abandoned.

(51) Int. Cl.
*B21B 19/04* (2006.01)
*B21B 23/00* (2006.01)

(52) U.S. Cl.
CPC ..... *B21B 19/04* (2013.01); *B21B 23/00* (2013.01); *B21B 2203/18* (2013.01)

(58) Field of Classification Search
CPC ..... B21B 19/04; B21B 19/02; B21B 19/00; B21B 25/00; B21J 5/10
See application file for complete search history.

(56) References Cited

U.S. PATENT DOCUMENTS 4,771,624 A * 9/1988 Vorbach ..... B21B 37/78 72/430
5,713,234 A * 2/1998 Yamakawa ..... B21B 19/06 72/97
6,988,387 B2 * 1/2006 Nakaike ..... B21J 5/10 72/97
2012/0137745 A1 * 6/2012 Marin ..... B21B 23/00 72/201

* cited by examiner

*Primary Examiner* — Bobby Yeonjin Kim
(74) *Attorney, Agent, or Firm* — Matthias Scholl P.C.; Matthias Scholl

(57) ABSTRACT

A method for piercing a titanium alloy solid billet, the method including: 1) providing a Mannesmann rotary piercer including two rollers, a feed channel, a plurality of centering devices, and a mandril including a plug; fixing the mandril using the plurality of centering devices, where the Mannesmann rotary piercer has a feeding angle of 6-18°, a cross angle of 15°, and a roll speed of 30-90 rpm; 2) heating a titanium alloy solid billet to 930-990° C.; 3) transferring the titanium alloy solid billet to the feed channel of the Mannesmann rotary piercer; and 4) aligning the titanium alloy solid billet with the plug of the mandril, and driving the titanium alloy solid billet to pass through the plug of the mandril, thereby piercing the titanium alloy solid billet and yielding a titanium alloy tube.

1 Claim, 6 Drawing Sheets

METHOD FOR PIERCING TITANIUM ALLOY SOLID BILLET

CROSS-REFERENCE TO RELATED APPLICATIONS

This application is a continuation-in-part of U.S. application Ser. No. 16/822,057, filed Mar. 18, 2020, and further claims foreign priority benefits to Chinese Patent Application No. 201910201337.1 filed Mar. 18, 2019. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to a method for piercing a titanium alloy solid billet.

Compared with steel, titanium alloy has large elastic modulus and high deformation resistance. Thus, in the process of two-roll rotary piercing, the titanium alloy billet is too hard and tends to be stuck in the rotary piercer, and the mandril for piercing the billet tends to lose the working position. The microstructure of titanium alloy is greatly affected by the deformation process parameters, so it is important to set the process parameters reasonably to obtain ideal microstructure.

SUMMARY

The disclosure provides a method for piercing a titanium alloy solid billet, the method comprising:

1) providing a Mannesmann rotary piercer comprising two rollers, two guide plates, a feed channel, a plurality of centering devices, and a mandril comprising a plug; fixing the mandril using the plurality of centering devices; wherein the two guide plates are disposed in an arrangement of plane symmetry and have a first symmetry plane intersecting the two rollers and a second symmetry plane perpendicular to the first symmetry plane; the Mannesmann rotary piercer has a feeding angle of 6-18°, a cross angle of 15°, a roll speed of 30-90 rpm, and a plug advance of 5-15 mm; the feeding angle refers to a projection of an included angle between an axis of one of the two rollers and an axis of a billet on the second symmetry plane, and the cross angle refers to a projection of an included angle between the axis of one of the two rollers and the axis of the billet on the first symmetry plane; the plug advance refers to the distance between the front end of plug and the roll gorge along the axis of the billet; the roll gorge refers to the position of minimum distance between the two rollers; a diameter reduction ratio of the billet is set as 6-12%, the diameter reduction ratio is expressed by the following equation: diameter reduction $$\text{ratio} = \frac{D_b - D_g}{D_b},$$

where $D_b$ is the diameter of the billet, $D_g$ refers to the distance between roll gorges of the two rollers;

2) heating a titanium alloy solid billet to 930-990° C.;

3) transferring the titanium alloy solid billet to the feed channel of the Mannesmann rotary piercer; and 4) aligning the titanium alloy solid billet with the plug of the mandril, and driving the titanium alloy solid billet to pass through the plug of the mandril, thereby piercing the titanium alloy solid billet and yielding a titanium alloy tube.

The mandril comprises a free end and a fixed end, and the plug is disposed on the free end; the centering device is installed in batches; the total centering devices is $2^n-1$ in number, and the centering devices added in each installation is $2^{n-1}$; each time the centering device is added, the axial force of the centering devices is checked. When the axial force of the mandril is not satisfied, the time (n+1) of installation of the centering devices is provided until all the axial force of the centering devices is satisfied. When n=1, only one centering device needs to be added, the distance between the centering device and the fixed end is $$\frac{2}{3}l;$$

when n=2, in addition to the centering devices added in the first batch, two additional centering devices need to be added, a distance between a first one of centering device and the fixed end is $$\frac{4}{9}l,$$

a distance between a second one of the centering device and the free end is $$\frac{2}{15}l;$$

when n is greater than 2, the centering devices need to be added is $2^{n-1}$ in number, a distance between a first one of the plurality of centering devices for each batch and the fixed end is $$\left(\frac{2}{3}\right)^n l,$$

where n refers to batch of installation of the centering devices, and l refers to a length of the mandril; a distance between a second one of the plurality of centering devices for each batch and the free end is $$\frac{1}{3}\times\left(\frac{2}{5}\right)^{n-1} l;$$

suppose a distance between two adjacent centering devices is a, additional centering devices are disposed between the two adjacent centering devices, and a distance between the additional centering devices and one of the two adjacent centering devices close to the free end is $\frac{2}{5}a.$ The heating time of the titanium alloy solid billet is D×(1.2 to 2) min, where D is the diameter of the titanium alloy solid billet with a unit of millimeter.

The two rollers each comprises a conical roll with double helix.

The Mannesmann rotary piercer comprises three cams for each centering device; an included angle of each two of the three cams is 120°, and the mandril is disposed in a hole enclosed by the three cams for each centering device.

The Mannesmann rotary piercer comprises two guide plates disposed between the two rollers, and the distance (Ddx) between the two guide plates is 1.05-1.1 times the distance (Dgx) of the two rollers in a cross section perpendicular to the axis of the billet, and a minimum distance between the two rollers is D×(1−diameter reduction ratio), where D is the diameter of the titanium alloy solid billet with a unit of millimeter.

The method further comprises cooling the titanium alloy tube in air.

The titanium alloy solid billet is prepared by melting in vacuum consumable electric arc furnace, forging and machining.

The method further comprises machining the head and tail of the titanium alloy tube.

In 4), the titanium alloy solid billet is pierced in the Mannesmann rotary piercer at the temperature between 860 and 1000° C.

DETAILED DESCRIPTION

To further illustrate, embodiments detailing a method for piercing a titanium alloy solid billet are described below. It should be noted that the following embodiments are intended to describe and not to limit the disclosure.

Figure 1:
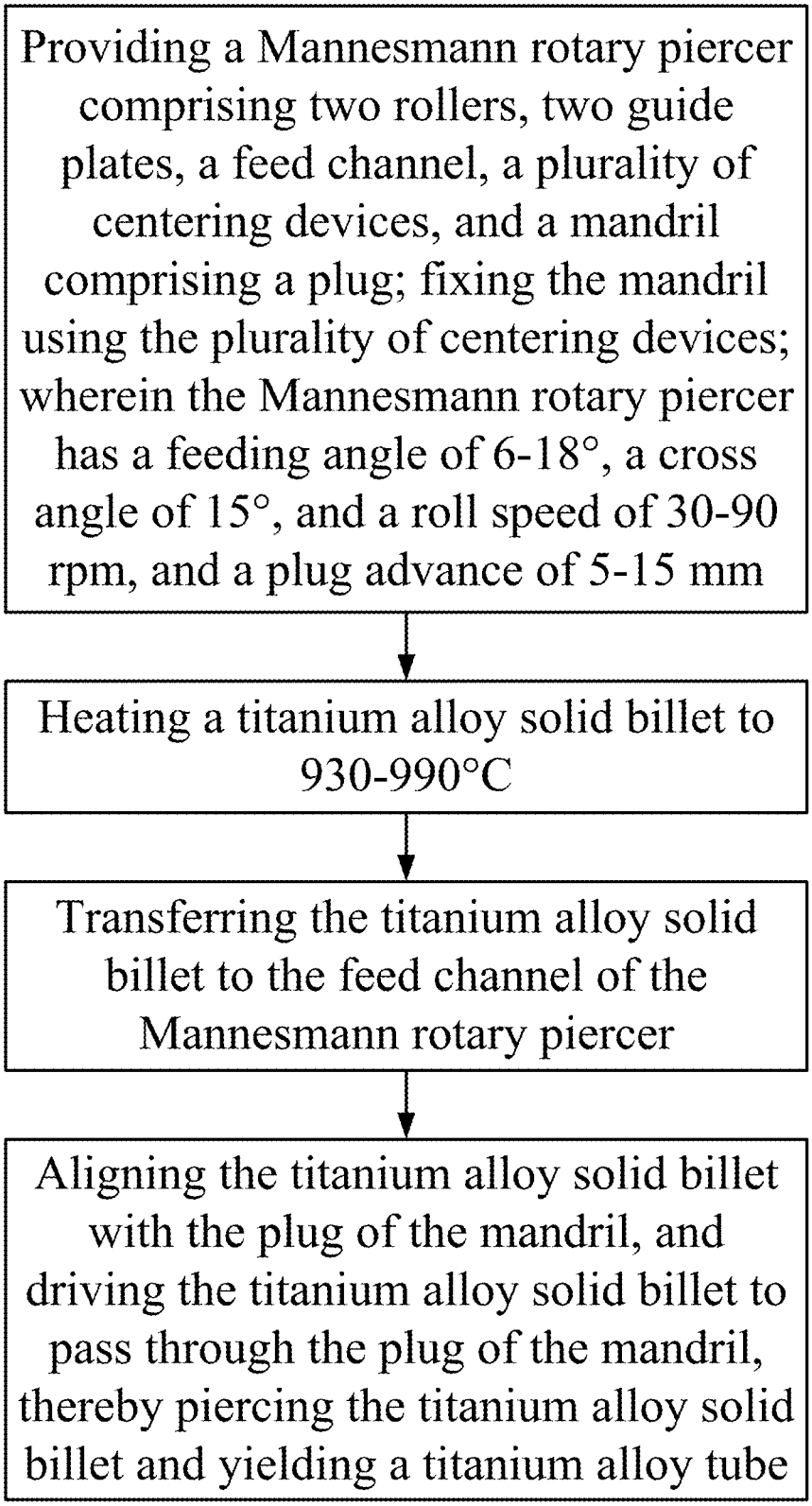
FIG. 1 is a flow chart of a method for piercing a titanium alloy solid billet according to one embodiment of the disclosure.

As shown in FIG. 1, provided is a flow chart of a method for piercing a titanium alloy solid billet. The method is detailed as follows:

1) Providing a Mannesmann rotary piercer comprising two rollers 201, two guide plates 204, a feed channel 301, a plurality of centering devices 302, and a mandril 202 comprising a plug 203; fixing the mandril using the plurality of centering devices. Specifically, three centering devices are provided, that is, one primary centering device 302A and two secondary centering devices 302B. The mandril comprises a free end 202A and a fixed end 202B. The distance between the one primary centering device and the fixed end 202B is approximately 513 mm. The distances between the two secondary centering devices and the fixed end and the free end are approximately 342 mm and 102.6 mm, respectively. The uneven distribution of the centering devices improves the stability of the mandril, and reduces the occurrence of the rolling block phenomenon (the alloy billet is stuck in the middle of the rotary piercer). The distance Ddx between the two guide plates is 1.05-1.1 times the distance Dgx of the two rollers in a cross section perpendicular to the axis of the billet, and a minimum distance between the two rollers is D×(1−diameter reduction ratio), where D is the diameter of the titanium alloy solid billet with a unit of millimeter.

Figure 2:
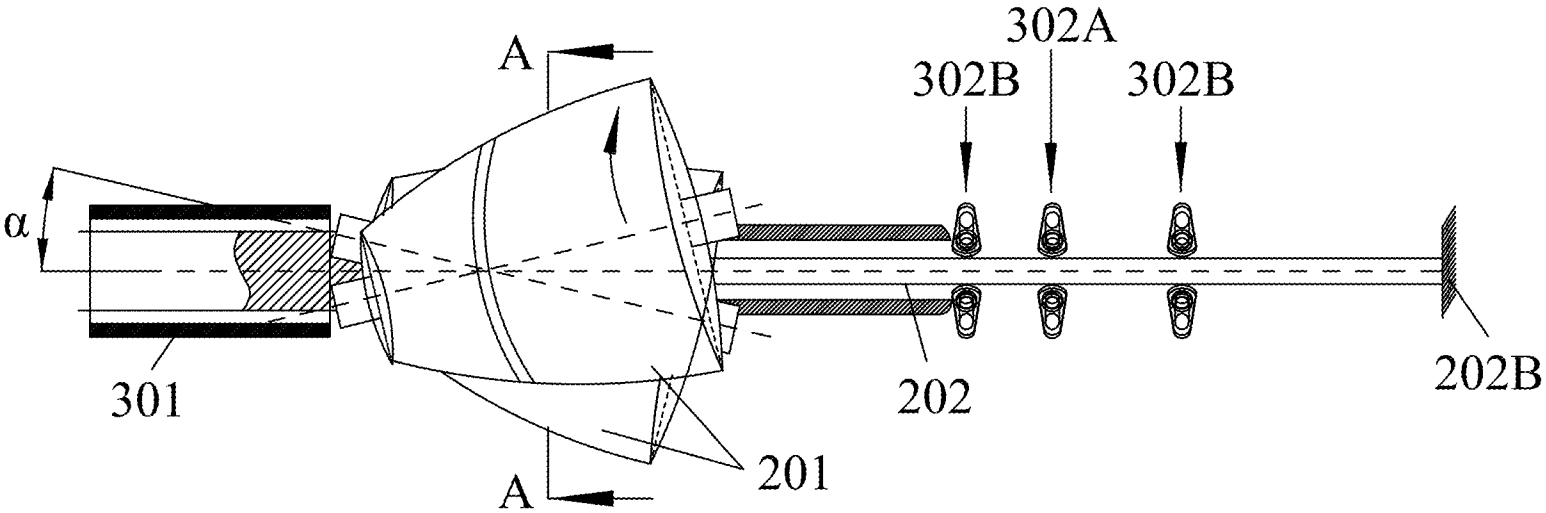
FIG. 2 is a schematic diagram of a Mannesmann rotary piercer in one angle of view showing the feeding angle of two rollers according to one embodiment of the disclosure.
Figure 3:
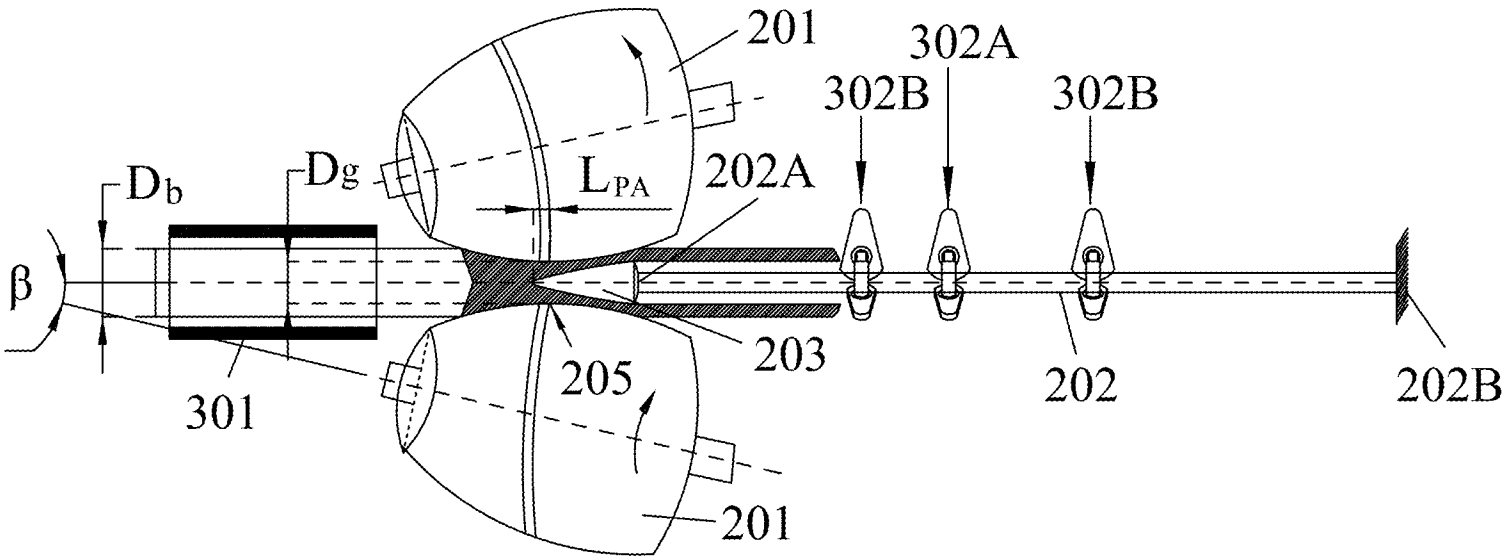
FIG. 3 is a schematic diagram of a Mannesmann rotary piercer in another angle of view showing the cross angle of two rollers according to one embodiment of the disclosure.
Figure 4:
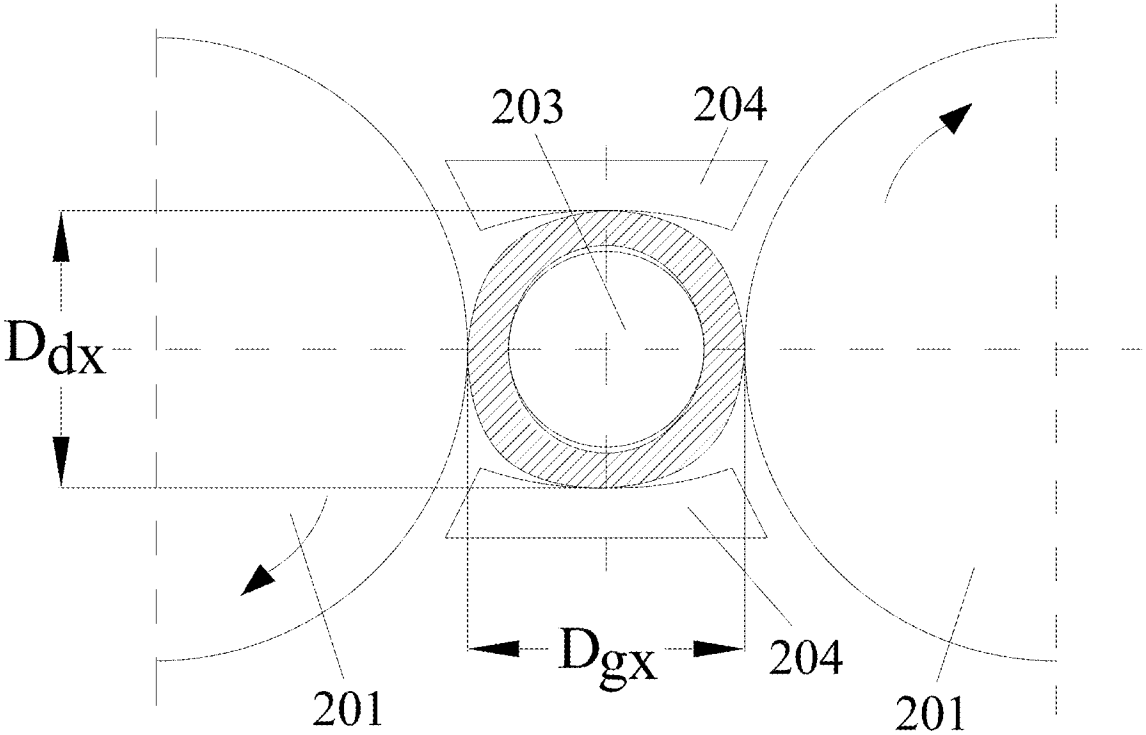
FIG. 4 is a sectional view taken from line A-A in FIG. 2.

2) As shown in FIGS. 2, 3 and 4, the Mannesmann rotary piercer has a feeding angle of 6-18°, a cross angle of 15°, a diameter reduction ratio of 6-12%, a roll speed of 30-90 rpm, and a plug advance of 5-15 mm. Specifically, the Mannesmann rotary piercer has a feeding angle α of 15°, a cross angle β of 15°, a diameter reduction ratio of 8%, and a roll speed of 60 rpm. The feeding angle refers to the projection of an included angle between the axis of one of the two rollers and the axis of the titanium alloy solid billet on a plane passing the axis of the billet and parallel to the A-A line, and the cross angle refers to the projection of an included angle between the axis of one of the two rollers and the axis of the titanium alloy solid billet on a plane perpendicular to the plane passing the axis of the billet and parallel to the A-A line. The plug advance $L_{PA}$ refers to the distance between the plug nose and the roll gorge 205 along the axis of the billet; the plug nose refers to the front end of plug; the roll gorge 205 refers to the position of minimum distance between the two rollers.

3) Heating a titanium alloy solid billet to 930-990° C.

In this disclosure, the titanium alloy solid billet is prepared by melting in vacuum consumable electric arc furnace, forging and machining. Specifically, three titanium alloy solid billets TC4 are provided, with dimension of Φ45×200 mm, Φ45×280 mm, and Φ45×420 mm, respectively. The microstructure of each part of the billets is even, and no defects such as inclusions and pores are found. The phase transformation temperature of the titanium alloy cylindrical billets is 1000° C.±5° C.; the initial microstructure of each part of the cylindrical billets is bimodal microstructure with 44% primary α phase, and the average grain size of primary α phase is 20 μm.

Figure 8:
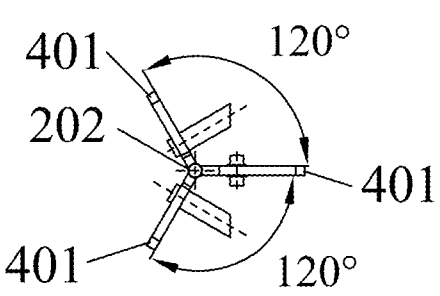
FIG. 8 is a schematic diagram of the mandril and a centering device of FIG. 6 from the direction of the axis of the mandril.
Figure 6:
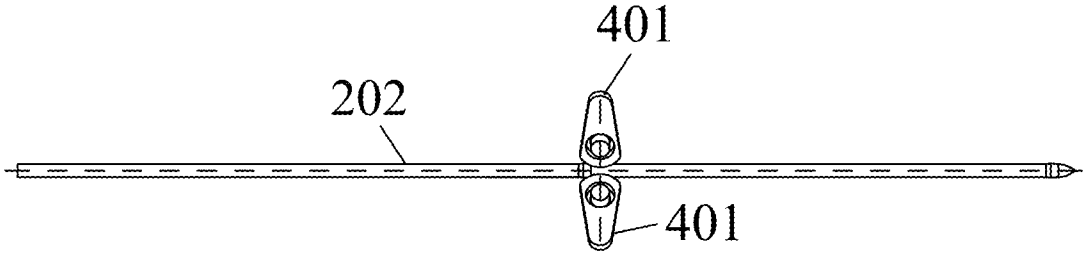
FIG. 6 is a flat view of a mandril and a centering device in a Mannesmann rotary piercer.
Figure 7:
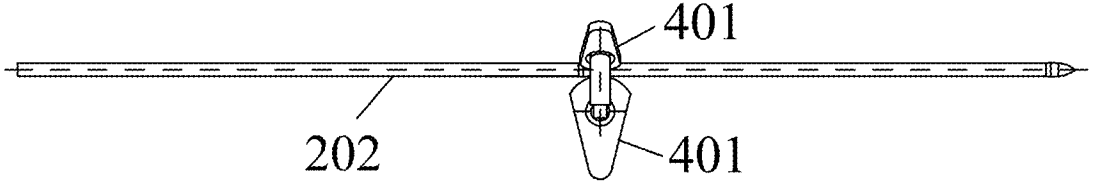
FIG. 7 is a top view of the mandril and a centering device of FIG. 6 from another perspective.

The three titanium alloy cylindrical billets are heated in a heating furnace. The heating temperature is 960° C.±10° C. and the heating time is 60 min. The shape of two rollers are all conical roll with double helix; As shown in FIGS. 6-8, The Mannesmann rotary piercer comprises three cams 401 for each centering device; the included angle of each two of the three cams is 120°, and the mandril is placed in the holes enclosed by three cams for each centering device.

4) Transferring the titanium alloy solid billet to the feed channel of the Mannesmann rotary piercer. The transit time is less than or equal to 5 seconds.

5) Aligning the titanium alloy solid billet with the plug of the mandril, and driving the titanium alloy solid billet to pass through the plug of the mandril, thereby piercing the titanium alloy solid billet and yielding a titanium alloy tube.

The rolling temperature of the titanium alloy solid billet is 860-1000° C.

Following 5), the titanium alloy tube is cooled in air, and the head and tail of the titanium alloy tube are machined.

After the piercing, the dimensions of the head and tail of the three titanium alloy tubes are shown in Table 1.

TABLE 1

| Dimensions of three titanium alloy tubes | | | | | | |
|---|---|---|---|---|---|---|
| | Head of titanium alloy tubes | | | Tail of titanium alloy tubes | | |
| Items | Outer diameter (mm) | Inner diameter (mm) | Wall thickness (mm) | Outer diameter (mm) | Inner diameter (mm) | Wall thickness (mm) |
| Φ45 × 200 mm | 47.10 | 19.90 | 13.20 | 46.90 | 19.80 | 13.55 |
| Φ45 × 280 mm | 47.20 | 20.10 | 13.40 | 47.00 | 20.00 | 13.50 |
| Φ45 × 420 mm | 47.00 | 19.80 | 12.70 | 46.80 | 19.80 | 13.8 |
| Variance | — | 0.09 | 0.01 | 0.05 | 0.02 | 0.03 |

As shown in Table 1, the variances between the inner diameter and the wall thickness of the three tubes with different lengths is less than 0.1, which indicates that the piercing method of the disclosure is accurate and stable, and the tubes with a diameter thickness ratio of about 3.5 are obtained.

Figure 5:
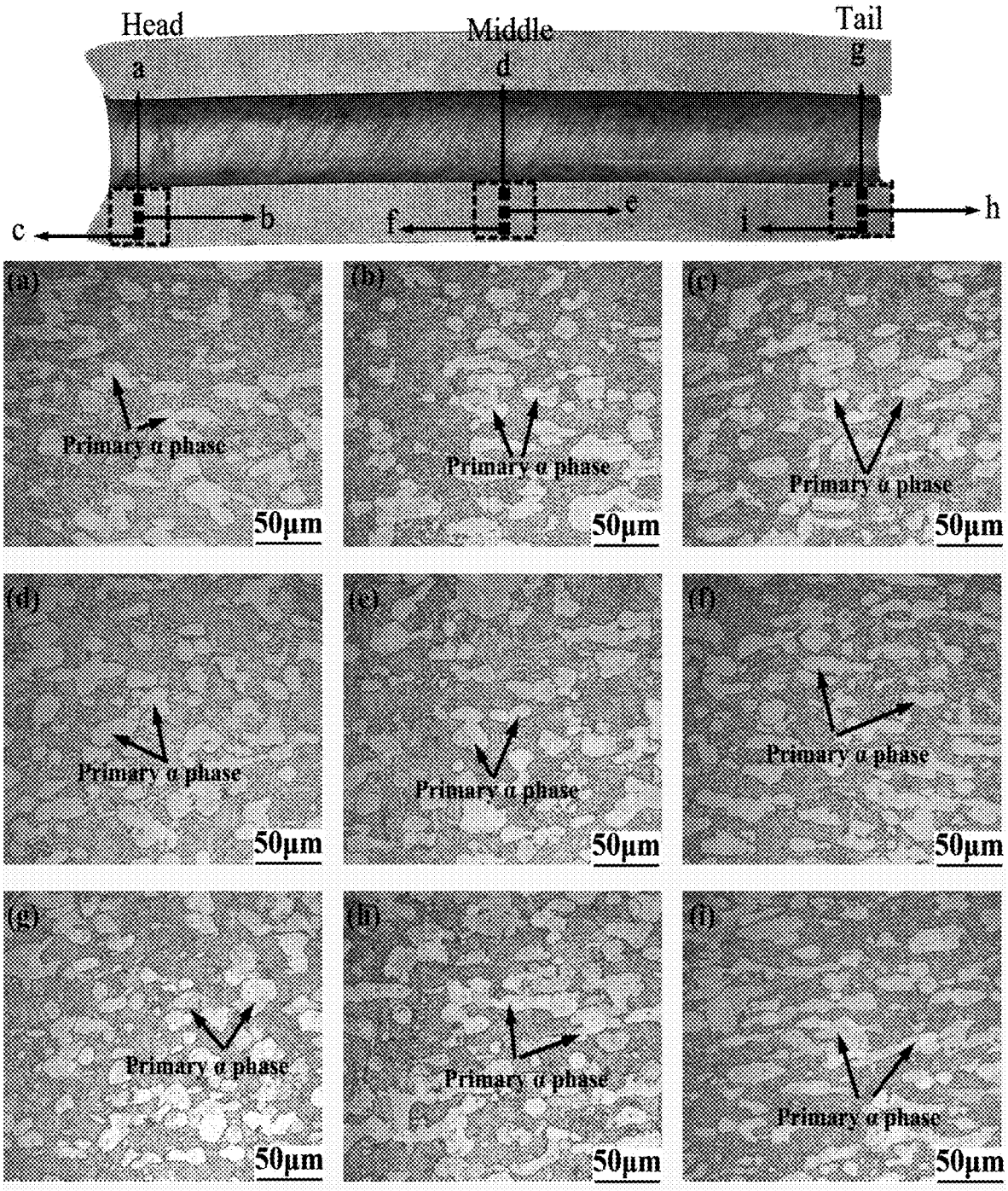
FIG. 5 is a photograph of the microstructures of the different parts of the billet with a length of 230 mm.

The microstructure of different parts of the billet with a length of 230 mm is studied. The samples are selected from the head, middle part and tail of the tube for metallographic analysis. As shown in FIG. 5, each sample is provided with three observation points along the radial direction. The three observation points of the head are a, b, and c along the radial distribution. The three observation points of the middle part are d, e, and f, respectively. The three observation points of the tail are g, h, and i. The radial and axial microstructure of the tube with bimodal microstructure is even across the section. According to statistics, the primary α phase of each part accounts for 15%-35%.

The obtained titanium alloy tubes of the disclosure have a bimodal microstructure. The primary α phase is equiaxed and accounts for 15%-35%. The diameter-thickness ratio of the titanium alloy bimodal microstructure tube is less than 4. The disclosure adopts a conical roll with double helix, a large feeding angle and cross angle, and the rolling parameters such as diameter reduction rate and the roll speed are reasonably designed, which can effectively avoid the temperature rise in the whole process of rotary piercing, and obtain a titanium alloy tube with bimodal microstructure.

By reasonably designing the feeding angle, cross angle, roll speed, diameter reduction rate of the Mannesmann rotary piercer and the length of the plug, the temperature rise of the alloy billet in the process of rotary piercing can be effectively controlled, thereby avoiding the formation of the Widmanstatten microstructure, and improving the quality of the titanium alloy tube with bimodal microstructure. The centering devices of the Mannesmann rotary piercer are unevenly distributed, thus improving the strength and rigidity of the centering devices acting on the mandril, and reducing the occurrence rate of the rolling block phenomenon.

It will be obvious to those skilled in the art that changes and modifications may be made, and therefore, the aim in the appended claims is to cover all such changes and modifications.

What is claimed is:

1. A method, comprising:

1) providing a Mannesmann rotary piercer comprising two rollers, two guide plates disposed in an arrangement of plane symmetry and have a first symmetry plane intersecting the two rollers and a second symmetry plane perpendicular to the first symmetry plane, a feed channel, a plurality of centering devices, and a mandrel comprising a plug;

fixing the mandrel using the plurality of centering devices;

wherein the mandrel defines a passing line;

the Mannesmann rotary piercer has a feeding angle of 6-18°, a cross angle of 15°, a roll speed of 30-90 rpm, and a plug advance of 5-15 mm; the feeding angle refers to a projection of an included angle between an axis of one of the two rollers and the passing line on the second symmetry plane, and the cross angle refers to a projection of an included angle between the axis of one of the two rollers and the passing line on the first symmetry plane; the plug advance refers to a distance between a front end of the plug and a roll gorge along the passing line, the roll gorge refers to a position of the two rollers where a distance between the two rollers is minimum; and a diameter reduction ratio of the billet is set as 6-12%;

2) heating a titanium alloy solid billet to 930-990° C.;

3) transferring the titanium alloy solid billet to the feed channel of the Mannesmann rotary piercer; and 4) aligning the titanium alloy solid billet with the plug, and driving the titanium alloy solid billet to pass through the plug, thereby piercing the titanium alloy solid billet and yielding a titanium alloy tube;

wherein the Mannesmann rotary piercer comprises three cams for each centering device; an included angle of each two of the three cams is 120°, and the mandrel is disposed in a hole enclosed by the three cams for each centering device.

* * * * *